US008490440B2

(12) United States Patent
Aykroyd et al.

(10) Patent No.: US 8,490,440 B2
(45) **Date of Patent: *Jul. 23, 2013**

(54) TIMING CONTROL AND TIMED WASH CYCLE FOR AN AUTOMATIC WASHER

(75) Inventors: Timothy Nicholas Aykroyd, Brookline, MA (US); Colleen M. Doyle, Stevensville, MI (US); Tremitchell Wright, Elkhart, IN (US); Joel Adam Luckman, Benton Harbor, MI (US); Janice M. Kaeding, Lawrence, MI (US); Michael Stephen Hendrickson, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1109 days.

This patent is subject to a terminal disclaimer.

(21) Appl. No.: 11/745,088

(22) Filed: May 7, 2007

(65) Prior Publication Data

US 2008/0276965 A1 Nov. 13, 2008

(51) Int. Cl.
*D06F 33/00* (2006.01)

(52) U.S. Cl.
USPC ..... 68/12.12

(58) Field of Classification Search
USPC ..... 8/158, 159
See application file for complete search history.

(56) References Cited

U.S. PATENT DOCUMENTS

| | | | | |
|---|---|---|---|---|
| 2,323,993 | A | 7/1943 | Harvey | |
| 2,371,720 | A * | 3/1945 | Stine | 422/266 |
| 2,430,668 | A | 11/1947 | Chamberlin | |
| 2,431,040 | A | 11/1947 | Harvey | |
| 2,540,431 | A | 2/1951 | Davis et al. | |
| 2,762,527 | A | 9/1956 | Manley | |
| 3,095,722 | A | 7/1963 | Fox | |
| 3,268,120 | A | 8/1966 | Durst | |
| 3,347,066 | A | 10/1967 | Klausner | |
| 3,567,076 | A | 3/1971 | Zanussi | |
| 3,702,069 | A | 11/1972 | Sharpe | |
| 3,736,773 | A | 6/1973 | Waugh | |
| 3,740,975 | A * | 6/1973 | Cornelius | 68/18 F |
| 3,982,666 | A | 9/1976 | Kleimola et al. | |
| 3,988,908 | A | 11/1976 | Beare et al. | |
| 4,110,075 | A | 8/1978 | Graf et al. | |

(Continued)

FOREIGN PATENT DOCUMENTS

| | | |
|---|---|---|
| EP | 0379665 | 8/1990 |
| EP | 0504545 A1 | 9/1992 |

(Continued)

*Primary Examiner* — Michael Barr
*Assistant Examiner* — David Cormier
(74) *Attorney, Agent, or Firm* — Clifton G. Green; Greer, Burns & Crain Ltd

(57) ABSTRACT

A control for an automatic washer to operate the washer through a wash cycle determined based upon various soils and stains in the substrate load to be washed with a wash liquor in a wash zone of the washer. The control has a plurality of stain/soil type entrées, which can be at least one of selected and detected, and cleaned with a particular wash cycle. The control has dispensing control over at least one wash liquor additive. The control has a user input to permit the user to customize the operation of the control with regard to the dispensing of the various wash liquor additive and a timing mechanism. The control has operational control over the particular wash cycles using the dispensing control to dispense additives to the wash liquor at selected times during the wash cycle.

12 Claims, 11 Drawing Sheets

U.S. PATENT DOCUMENTS

| | | | | |
|---|---|---|---|---|
| 4,120,650 | A | 10/1978 | Kappler et al. | |
| 4,188,807 | A | 2/1980 | Graf et al. | |
| 4,503,575 | A | 3/1985 | Knoop et al. | |
| 4,867,193 | A | 9/1989 | Hayashi et al. | |
| 5,014,211 | A | 5/1991 | Turner et al. | |
| 5,297,307 | A | 3/1994 | Baek | |
| 5,870,906 | A | 2/1999 | Denisar | |
| 5,897,671 | A | 4/1999 | Newman et al. | |
| 6,055,831 | A | 5/2000 | Barbe | |
| 6,463,611 | B1 | 10/2002 | Mattia et al. | |
| 6,482,242 | B2 | 11/2002 | Yarmosky | |
| 6,502,265 | B2 | 1/2003 | Blair et al. | |
| 6,553,594 | B2 | 4/2003 | Broker et al. | |
| 6,557,732 | B2 | 5/2003 | Van Rompuy et al. | |
| 6,581,800 | B2 | 6/2003 | Rodd et al. | |
| 6,671,916 | B2 | 1/2004 | Herr et al. | |
| 6,789,404 | B2 | 9/2004 | Kim et al. | |
| 6,792,637 | B2 | 9/2004 | Reichold et al. | |
| 6,863,798 | B2 | 3/2005 | Nakamura et al. | |
| 6,955,067 | B2 | 10/2005 | Davenet et al. | |
| 7,036,176 | B2 | 5/2006 | Aouad et al. | |
| 7,113,280 | B2 | 9/2006 | Oon et al. | |
| 7,114,209 | B2 | 10/2006 | Metzger-Groom et al. | |
| 7,476,258 | B2 | 1/2009 | Birker et al. | |
| 7,516,629 | B2 | 4/2009 | Behrens et al. | |
| 2001/0049846 | A1 | 12/2001 | Guzzi et al. | |
| 2001/0049947 | A1 * | 12/2001 | Whah et al. | 68/12.02 |
| 2003/0051296 | A1 | 3/2003 | Broker et al. | |
| 2003/0106164 | A1 | 6/2003 | Metzger-Groom et al. | |
| 2003/0116177 | A1 | 6/2003 | Appel et al. | |
| 2003/0154560 | A1 | 8/2003 | Behrens et al. | |
| 2003/0213505 | A1 | 11/2003 | Price et al. | |
| 2004/0134238 | A1 | 7/2004 | Buckroyd et al. | |
| 2004/0148708 | A1 | 8/2004 | Stoessel et al. | |
| 2005/0022314 | A1 * | 2/2005 | Ambuter et al. | 8/158 |
| 2005/0144737 | A1 | 7/2005 | Roepke et al. | |
| 2005/0188731 | A1 | 9/2005 | Aouad | |
| 2005/0274157 | A1 | 12/2005 | Yang | |
| 2006/0081016 | A1 | 4/2006 | Hsu et al. | |
| 2006/0107705 | A1 | 5/2006 | Hsu et al. | |
| 2008/0276655 | A1 | 11/2008 | Luckman et al. | |
| 2008/0276964 | A1 | 11/2008 | Hendrickson | |

FOREIGN PATENT DOCUMENTS

| | | | |
|---|---|---|---|
| GB | 1062774 | | 3/1967 |
| GB | 2179683 | | 3/1987 |
| GB | 2052251 | | 1/1991 |
| GB | 2417492 | A | 3/2006 |
| JP | 54-112566 | | 9/1979 |
| JP | 63-318997 | | 12/1988 |
| JP | 63-318997 | | 6/1991 |
| JP | 04-263898 | | 9/1992 |
| JP | 05-345090 | | 12/1993 |
| JP | 6-086894 | | 3/1994 |
| JP | 06-261995 | | 9/1994 |
| JP | 09-056971 | | 3/1997 |
| JP | 09-094372 | | 4/1997 |
| JP | 11-047486 | | 2/1999 |
| JP | 2000-157775 | | 6/2000 |
| JP | 2001-008881 | | 1/2001 |
| JP | 2002-102582 | | 4/2002 |
| WO | 0220893 | A1 | 3/2002 |
| WO | 2005058126 | A1 | 6/2005 |
| WO | 2006021773 | A1 | 3/2006 |

* cited by examiner

ADD WATER
140
SOAK SELECTED?
142
YES
NO
WATER LEVEL?
144
REGULAR
LOW
GARMENTS PRESENT?
146
NO
YES
ADD 1-2X THE RECOMMENDED AMOUNT OF PEROXIGEN AGENTS AT START OF CYCLE
152
ADD RECOMMENDED AMOUNT OF PEROXIGEN AGENTS.
156
POTENTIAL PHASES?
158

140
ADD WATER
142
SOAK SELECTED?
NO
170
WATER LEVEL?
HIGH
LOW
REGULAR

172
UTILIZE RECICULATION
YES
NO
174
ENTIRE DETERGENT DISPENSED BETWEEN 0-10 MIN.
186
FOAM
188
STEAM
190
CONCENTRATED LIQUOR
POTENTIAL PHASES?
184

140
ADD WATER
142
SOAK SELECTED?
YES
NO
170
WATER LEVEL?
HIGH
REGULAR
202
AGITATION TIME
EXTENDED
SHORT
REGULAR
214
WATER TEMP.
ANY TEMP
COLD SPECIFICALLY (<25° C)

204
1ST ADDITIVE
DETERGENT
PEROXIGEN AGENTS
206
ADD DETERGENT BETWEEN +0-10 MIN.
210
ADD PEROXIGEN AGENTS BETWEEN +0-10 MIN.
216
1ST ADDITIVE
PEROXIGEN AGENTS
DETERGENT
218
ADD PEROXIGEN AGENTS BETWEEN +0-10 MIN.

| FIG. 6A | FIG. 6B |
| --- | --- |
| | FIG. 6C |

TIMING CONTROL AND TIMED WASH CYCLE FOR AN AUTOMATIC WASHER

BACKGROUND OF THE INVENTION

The present invention relates to washer controls, wash cycles and automatic washers.

In appliances that are used to treat various substrates, such as laundry appliances that treat fabrics and dishwashers that treat dishware, oftentimes different chemistries are added to the appliance during different treatment cycles or at different times during a given treatment cycle, depending on the treatment function to be performed, and depending on the item being treated, for example. It is known to provide a washer and control where specific stains are identified, and a wash cycle is carried out based on the particular stain in combination with additional, default parameters, as disclosed in U.S. published patent application US2003/0154560.

Storage and dispensing of specific cleaning constituents into a laundry appliance is described in U.S. Pat. No. 4,110,075. Temperature and water level sensors are utilized to determine when various constituents are to be dispensed.

Where the bleaching agents and the detergent are introduced separately, only rudimentary washer controls have been provided to automatically dispense the bleaching agent additive at a certain predetermined point in the wash cycle, regardless of the type of stain or soil present in the wash load. Even though different stains and soils are removed more effectively with different types of detergents or bleaching agents, or combinations of the two provided at varying times during the wash cycle, controls for washers have not been provided to take advantage of the more effective combinations or times of delivery.

It would be an improvement in the art if there were provided a control for an automatic washer that would use sensors to determine when chemistry should be released into the washer, which would allow the user to customize the washer to their specific needs and which would deliver the chemistry at the correct time to maximize the cleaning potential of the chemistry.

SUMMARY OF THE INVENTION

A control is provided for an automatic washer to operate the washer through a wash cycle determined based upon a range of conditions of the fabric load to be washed with a wash liquor in a wash zone of the washer. In an embodiment of the invention, the control includes a plurality of stain/soil type entrées, which can be at least one of selected and detected, and cleaned with a particular wash cycle. The control also has a timing mechanism, a dispensing control over at least one wash liquor additive and a user input to permit the user to customize the operation of the control with regard to the dispensing of the various wash liquor additives. The control operates the particular wash cycles using the dispensing control to dispense additives to the wash liquor at determined times during the wash cycle.

In an embodiment, the control includes a stain component sensor located in the wash zone to detect a particular type of stain on the substrate load to be cleaned.

In an embodiment, the control includes a plurality of predetermined wash cycles stored in a memory of the control, for use in operating the washer based upon a detected stain.

In an embodiment, the control includes a plurality of predetermined wash cycles stored in a memory of the control, for use in operating the washer based upon a user selected stain.

In an embodiment, the timing mechanism includes a timer used to dispense particular wash liquor additives at specific times during a particular wash cycle.

In an embodiment, the timing mechanism comprises a sensor used to determine when a particular stain or soil is present and requires a particular wash liquor additive to be dispensed to remove that particular stain or soil.

In an embodiment, the user input permits the user to elect whether to or not to dispense a particular type of wash liquor additive for a particular wash cycle.

In an embodiment, the user input permits the user to determine a time for releasing a particular wash liquor additive during a particular wash cycle.

In an embodiment, the user input comprises an electromechanical dial with multiple user selectable positions.

In an embodiment, the stains to be cleaned are identified in the control as one of proteins, fats, semisolids, complex, particular, soil, enzyme sensitive, pH sensitive and surfactant sensitive.

In an embodiment, the stain/soil type entrées are selected from the group consisting of grass, blood, coffee, tea, red wine, tomato-based, fruit juices, cocoa, carbon, perspiration, dirt, pigments, colors, foods, mud and oily stains and soils.

In an embodiment of the invention, a wash cycle is provided which includes the steps of:

loading a wash machine with a substrate load for cleaning, selecting a wash cycle based on at least a stain/soil in the substrate load, contacting the substrate load with a wash liquor, after a first predetermined time, dispensing a first wash liquor additive into the wash liquor, and after a predetermined time following the dispensing of the first wash liquor additive, dispensing a second wash liquor additive.

In an embodiment, the selecting step includes a user inputting a stain/soil type into a control of the washer.

In an embodiment, the first predetermined time is based on a selection made by the user.

In an embodiment, the predetermined time following the dispensing of the first wash liquor additive is dependent upon one of the type of stain/soil in the substrate load and the temperature of the wash liquor.

In an embodiment of the invention, a substrate treating appliance is provided utilizing a plurality of different chemistries for different cycles or different wash loads and having a control for operating the appliance. The appliance includes a wash zone for receiving a substrate load to be washed through contact with a wash liquor. The control includes a plurality of stain/soil type entrées, which can be at least one of selected and detected, and cleaned with a particular wash cycle. The control also has a timing mechanism, a dispensing control over at least one wash liquor additive and a user input to permit the user to customize the operation of the control with regard to the dispensing of the various wash liquor additives. The control operates the particular wash cycles using the dispensing control to dispense additives to the wash liquor at determined times during the wash cycle.

In an embodiment, the user input permits selection of a wash liquor temperature.

In an embodiment, the user input permits selection of a stain/soil type.

In an embodiment, the user input permits selection of a delay period for dispensing the first wash liquor additive.

In an embodiment, the user input permits selection of a particular additive to be added or not added to the wash liquor.

DETAILED DESCRIPTION OF THE PREFERRED EMBODIMENTS

Figure 1:
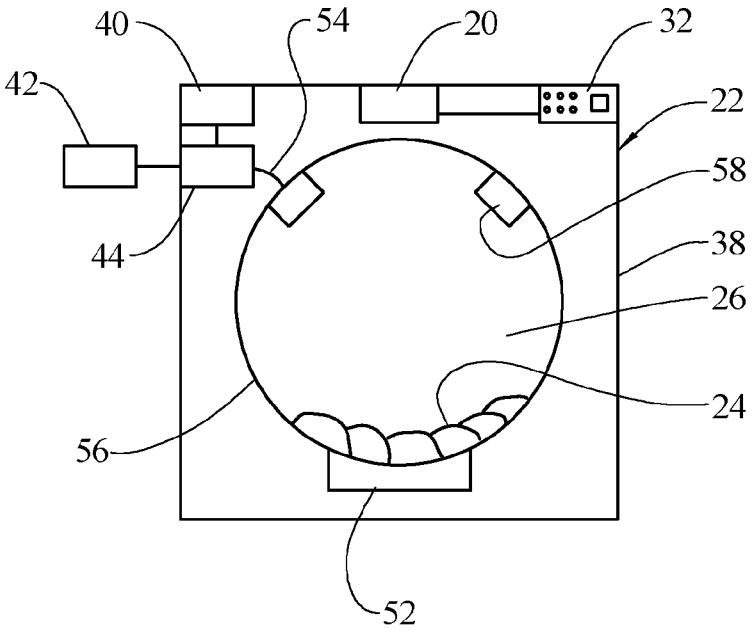
FIG. 1 is a schematic illustration of a control for an automatic washer.
Figure 2:
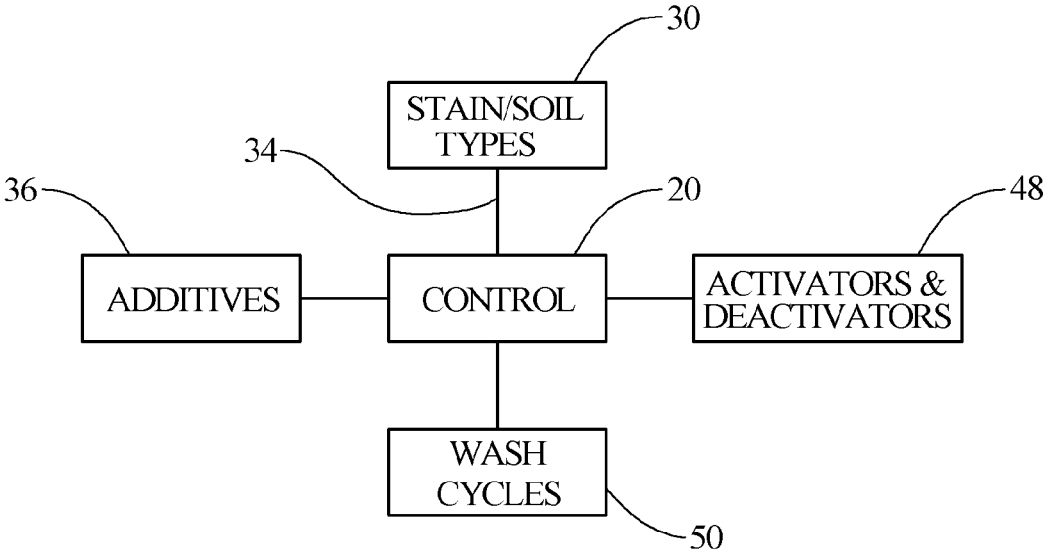
FIG. 2 is a schematic illustration of an automatic washer

In an embodiment of the invention, as shown in FIGS. 1 and 2, the present invention provides a control 20 for an automatic washer appliance 22 to operate the washer through a wash cycle determined based various soils or stains in the materials or substrates 24 to be cleaned. The washer 22 can be used to clean fabrics, such as a clothes washer or clothes refresher, could be used to clean dishware, such as a dishwasher, or could be used to clean other substrates.

In the case of a clothes washer 22, which particular embodiment will be described herein, even though the invention is not limited to such an environment, the fabric load 24 is arranged to be washed with a wash liquor after the fabric load has been introduced to a wash zone 26 of the washer. The wash liquor generally is a fluid, and may be a liquid, a gas, a vapor, a foam, or some combination of these states and may be an aqueous or non-aqueous solution or mixture.

The control 20 includes a plurality of stain/soil type entrees 30, which can be at least selected or detected, and then used to clean the fabric load with a particular wash cycle. For example, the control 20 may include a user interface 32 where a user can enter or select the type of soil or stain that is present in the fabric load 24, from a list of stain/soil entrées, or by entering information to identify a type of stain or soil. The user interface 32 could include switches or buttons dedicated to particular stains or soils, or there could be an electronic display with a drop down menu listing a variety of stain/soil entrées. A keypad may be provided to allow a user to type in or otherwise choose a particular stain or soil, and the control may then use that information to look up information about that particular stain or soil, from an internal database or memory store, whether that memory is part of software, firmware or is hard wired, or from an external database or memory store, including accessing a remote database or memory store on a local area network, a wide area network or a world wide network, such as the internet.

The user interface 32 could also allow the user to select a temperature range for the wash liquor, input information regarding the substrates making up the load, such as the type of fabrics that are to be cleaned, for example, whites, colored fabrics, delicate fabrics, etc. The interface could also allow the user to select a time for the wash cycle, such as normal, short or extended, as well as to select or prevent certain wash additives from being introduced to the wash liquor for that particular wash cycle. The user could select to advance or delay the timing for adding various wash liquor additives, and could also select an energy saving mode for the wash cycle.

Also, the control 20 could include an electronic input for receiving a signal on line 34 indicative of at least one of the stain type entrées. In this way, the stain types could be selected based upon a detection of the stains present prior to or during the wash cycle, such as by a reflectivity or emissivity reading of the fabric load, or a sensing of the presence of particular stain attributes during the wash cycle, such as the presence of proteins being released into the wash liquor.

The stains/soils to be removed may be identified in the control 20 as one of proteins, fats, semisolids, complex, particular, soil, enzyme sensitive, pH sensitive and surfactant sensitive. Each of these categories may have one or more specific wash cycles associated with it. For example, a particular soil/stain type could have several different cycles associated with it depending on the particular wash temperature a user has selected, based on the particular type of substrate involved, such as permanent press, delicate, or colored fabrics, or based on other input factors provided on the control.

The stain/soil type entrées may include grass, blood, coffee, tea, red wine, fruit juices, cocoa, tomato-based, carbon, perspiration, pigments, colors, foods, dirt, mud and oily stains or soils, which might be accessed directly or by first selecting a category or stains/soils.

The control 20 has dispensing control over various wash liquor additives 36 including detergents, chlorine bleaches, color safe bleaches, cleaning boosters, oxidizing agents, pre-wash stain removers, pre-wash chemistries, switchable or tunable surfactants, wrinkle guard, color finishes, water repellency, stain guard, functional finishes, fabric softeners, water softeners, fragrances, anti-static agents, drying aids, de-wrinkling chemistries, deodorizers, surfactants, emulsifiers, enzyme activated stain removers, sudsing agents, builders, anti-redeposition polymers, in-wash stain removers, water conditioning agents and perfumes.

The oxidizing agents which may be used as additives include active oxygen releasing compounds, e.g., peroxides (peroxygen compounds) such as perborate, percarbonates, perphosphates, persilicates, persulfates, their sodium, ammonium, potassium and lithium analogs, calcium peroxide, zinc peroxide, sodium peroxide, carbamide peroxide, hydrogen peroxide, and the like. These agents also include peroxy acids and organic peroxides and various mixtures thereof.

A peroxy acid is an acid in which an acidic —OH group has been replaced by an —OOH group. They are formed chiefly by elements in groups 14, 15 and 16 of the periodic table, but boron and certain transition elements are also known to form peroxy acids. Sulfur and phosphorus form the largest range of peroxy acids, including some condensed forms such as peroxydiphosphoric acid, $H_4P_2O_8$ and peroxydisulfuric acid, $H_2S_2O_8$. This term also includes compounds such as peroxycarboxylic acids and meta-chloroperoxybenzoic acid (mCPBA).

Organic peroxides are organic compounds containing the peroxide functional group (ROOR'). If the R' is hydrogen, the compound is called an organic hydroperoxide. Peresters have general structure RC(O)OOR. The O—O bond easily breaks and forms free radicals of the form RO.. This makes organic peroxides useful for cleaning purposes.

There are four possible descriptions of the oxidizing agent product composition based on concentration. "Ultra concentrated" means that 80 to 100% of the bleach is active. "Concentrated" means that 40 to 79% of the bleach is active. "Bleach with additive" means that 20-40% of the bleach is active. "Cleaning product with bleach" means that less than 25% of the bleach is active.

Oxidizing agents may be combined within a mixture that has a selection of other additive material, such as one or more of the following: builders, surfactants, enzymes, bleach activators, bleach catalysts, bleach boosters, alkalinity sources, antibacterial agents, colorants, perfumes, pro-perfumes, finishing aids, lime soap dispersants, composition malodor control agents, odor neutralizers, polymeric dye transfer inhibiting agents, crystal growth inhibitors, photobleaches, heavy metal ion sequestrants, anti-tarnishing agents, anti-microbial agents, anti-oxidants, linkers, anti-redeposition agents, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters, fabric softeners, antistatic agents, dye fixatives, dye abrasion inhibitors, anti-crocking agents, wrinkle reduction agents, wrinkle resistance agents, soil release polymers, soil repellency agents, sunscreen agents, anti-fade agents, water soluble polymers, water swellable polymers and mixtures thereof.

A particular oxidizing agent to be added to form the oxidizing agent wash liquor could comprise a combination of water with one or more of sodium carbonate, sodium percarbonate, surfactants and enzymes.

These wash liquor additives 36 may be stored internal or external to a cabinet 38 of the washer, such as in one or more internal containers 40 or external containers 42, or may be generated at or near the washer at the time they are needed for a particular wash cycle. Precursor chemicals may be stored at the washer, to be combined or acted upon at the time of need for a particular additive, so that unstable additives can be utilized by being generated just prior to their use. Oxidizing agents, such as hydrogen peroxide could be generated by electrolysis at a time of need, as could ozone and other additives. The additives 36 may be in the form of solids, liquids, gases, gels, foams and vapors, as well as in the form of electromagnetic radiation, such as UV. A mixing chamber 44 could also be provided wherein one or more of the additives or chemistries could be introduced to a portion of the wash liquor, and diluted therein, before being introduced to the fabric load 24.

The control 20 has operational control over activators and deactivators 48 for various of the additives. The activators and deactivators 48 may include thermal, biological, chemical, electromagnetic and mechanical actions. The biological activators and deactivators may include the use of enzymes and microbes. The chemical activators and deactivators may include the use of pH control, precious/noble metals, ionization, switchable surfactants, catalytic agents, anti-suds materials, and ozone. The electromagnetic activators and deactivators may include the use of UV, microwaves, electromagnetic radiation, electrolysis, visible light, electric shock and magnetic fields. The mechanical action activators and deactivators may include the use of tumbling, impelling, nutating, agitating, flexing of the fabric load, sonic, acoustics, megasonics, cradle, spinning and ultrasound.

The deactivators 48 may include removing or rendering ineffective an activator or the result of an activator. For example, if metal ions are used to catalyze an activation of an oxidizing agent, the metal ions may be captured or removed from the wash liquor prior to the wash liquor being disposed.

The control 20 has operational control over the particular wash cycles 50 using the dispensing control to dispense additives 36 to the wash liquor at selected times during the wash cycle and operating the activators and deactivators 48 at selected times during the wash cycle 50. The activators and deactivators 48 may be operated during different portions of the wash cycle 50 such as soak, pre-wash, standard wash, pre-rinse, rinse, fluid recovery and pre-drain.

The activation and deactivation 48 may be carried out in a single stage, a dual stage or in multiple stages. Several methods could be used in combination or in parallel to activate. For example, an oxidizing agent, such as hydrogen peroxide could be added, activating the hydrogen peroxide with a temperature increase, adding a catalyst, further temperature adjustment and then adding ozone.

When utilizing switchable solvents, depending on the goal of the process step, particularly cycle transitions (such as amount of suds, efficiency, extraction and soluability), the solvent could be controlled, for example by pH, light, acoustics or the introduction of gases.

As examples, during the wash step, a goal could be the prevention of suds lock which can be achieved by increasing surface tension. During the extraction step, a goal could be improving extraction efficiency which can be achieved by decreasing surface tension. During a rinse step, a goal could be a clean rinse with no suds which can be achieved by increasing surface tension. Also, during the rinse step the pH could be neutralized.

In some situations, the desired effect would be the curing of the additive onto the fabric or other substrate itself, such as is done with wrinkle guard or stain guard, color finishes, water repellency, functional finishes. This could be accomplished through nano-curing. With these finishes, extreme conditions such as very high temperature or very high pH are required. However, an activation method (such as UV or pH) could be used to overcome these conditions.

The additives 36 could be stored or introduced to the wash liquor in a variety of locations including a sump 52, the storage/holding container 42 or a line 54 from a dispenser 44 to a drum 56 defining the wash zone 26.

In order to activate some additives, extreme conditions are necessary. For example, very high pHs are needed for some situations. Use of a percarbonate as an oxidizing agent results in sodium carbonate and carbonate ion which can generate a pH in the rage of about 12, depending on the temperature and concentration of the solutes in solution. To achieve a stronger bleaching agent, sodium diborate (Na4B2O5) can generate a pH as high as about 12.5 (that is, more hydroxyl ion concentration) depending on the temperature and concentration of sodium diborate in solution. This pH range is higher than pH generated by carbonate ion. A solution can be prepared with a combination of sodium diborate and hydrogen peroxide, with activation by one or more lasers 58 operating in the 320 to 390 nm wavelength range.

The control 20 operates the dedicated wash cycles, as selected, using both the detergent and the oxidizing agent, however, the detergent and the oxidizing agent may be dispensed in different orders and at different times and in different amounts, as detailed below, depending on the stain type selected.

The control 20 may also have dispensing control over other types of chemistries including pre-wash chemistries, fabric softeners, water softeners, fragrances, anti-static agents, drying aids, de-wrinkling chemistries, deodorizers, etc.

In an embodiment, the control 20 could also include selectable water level entrées or wash liquor entrées. In this embodiment, the control 20 would have dispensing control over hot water and cold water inlet valves or other inlet valves for dispensing a wash liquor into the wash zone 26. The water level or wash liquor entrées could comprise high, low and regular levels. A sensor in the wash tub, or in the inlet lines could be used to determine the volume of water or wash liquor that had been introduced into the wash zone 26. These selections could be made by the user through the control interface, or could be selected automatically by the control 20 based on other selected parameters or based on sensed parameters of the fabric load 24.

In an embodiment, the control 20 could also include a selection for recirculation of the wash liquor. This selection could be made by the user through the control interface, or could be selected automatically by the control 20 based on other selected parameters or based on sensed parameters of the fabric load 24.

In an embodiment, the control 20 could also include selectable agitation time entrées. The control 20 could include a timer for controlling the agitation times as well as other aspects of the wash cycle, including the dispensing of various additives. For example, the agitation time entrées could comprise short, extended and regular agitation times. These selections could be made by the user through the control interface, or could be selected automatically by the control 20 based on other selected parameters or based on sensed parameters of the fabric load 24.

In an embodiment, the control 20 could also include selectable water temperature entrées. For example, the water temperature entrées could comprise hot, warm, cold, tap cold and any temperature. These selections could be made by the user through the control interface, or could be selected automatically by the control 20 based on other selected parameters or based on sensed parameters of the fabric load 24.

In an embodiment, the control 20 could be arranged to dispense the oxidizing agent either instantaneously in bulk or at a controlled rate. This control feature could be selected by the user through the control interface, or could be selected automatically by the control based on other selected parameters or based on sensed parameters of the fabric load 24.

Specific wash cycles are illustrated in FIGS. 3-6.

Figures 3, 3A, 3B, 4:
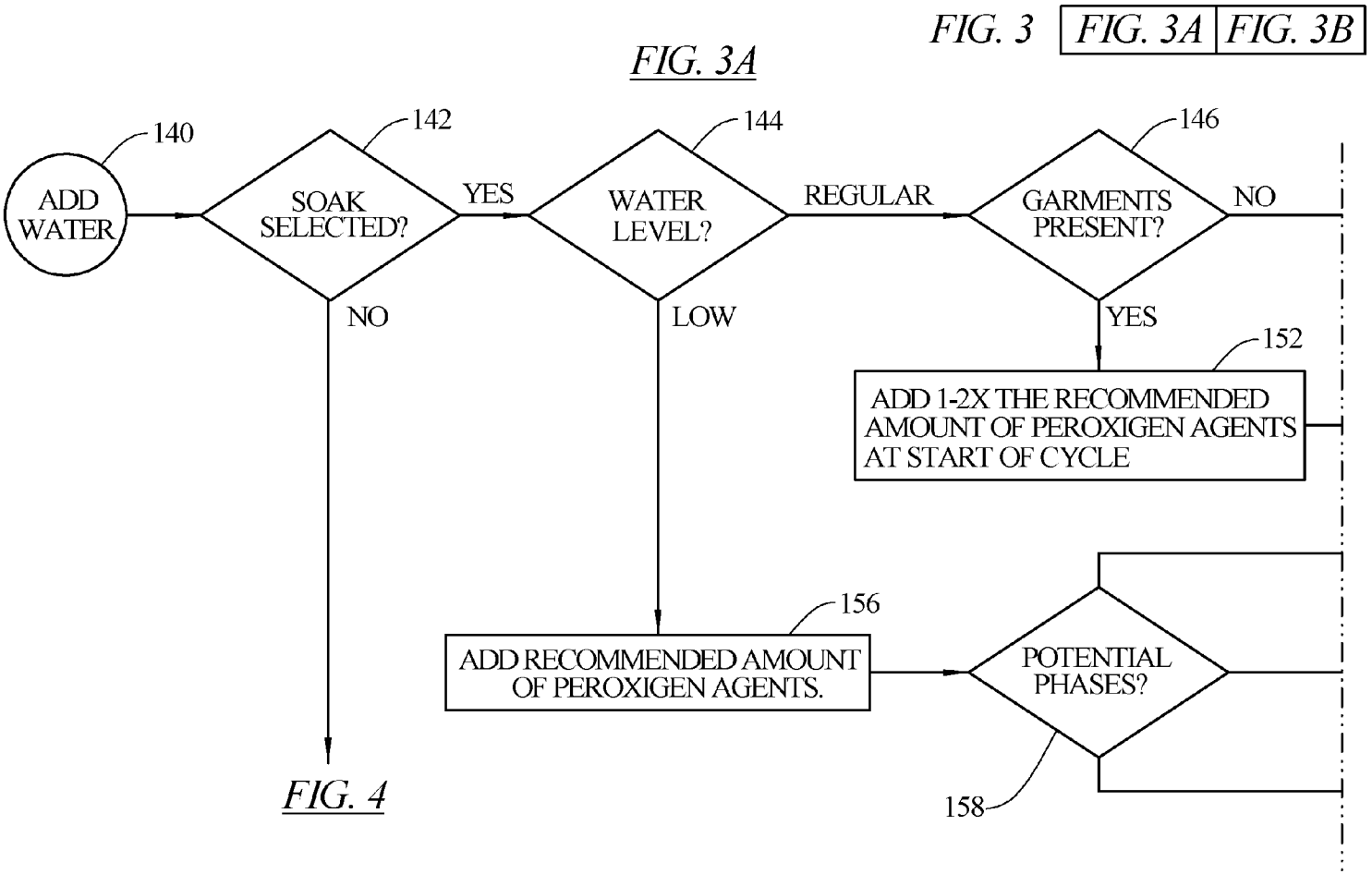
FIG. 3 is a flow chart diagram of a wash cycle embodying the principles of the present invention.
FIG. 4 is a flow chart diagram of a wash cycle embodying the principles of the present invention.
Figure 3B:
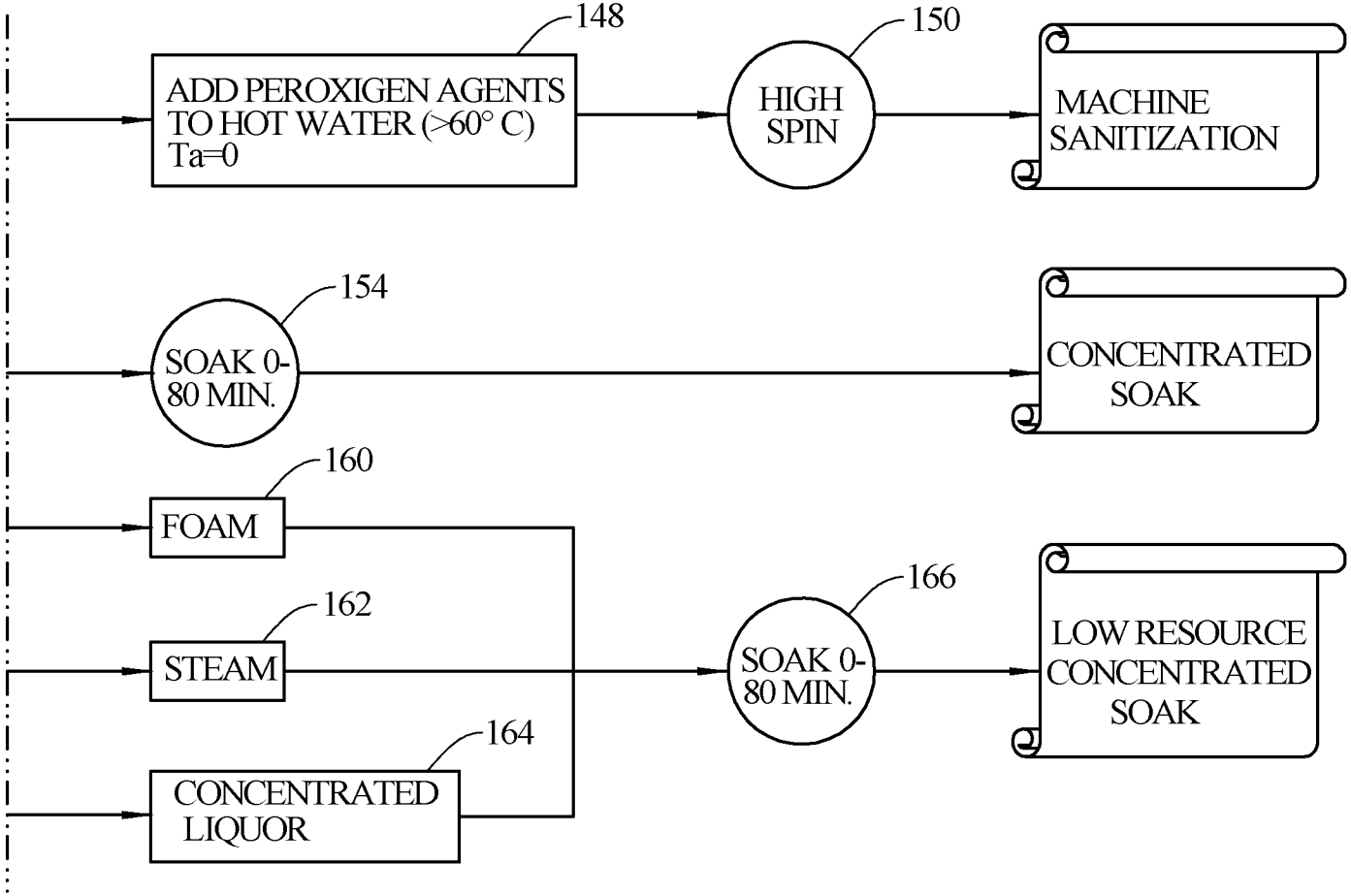

In FIG. 3, there is illustrated a cycle for sanitizing the machine. In step 140, water is added by controlling the water inlet valves. In step 142, a determination is made as to whether a soaking operation has been selected. If that determination is yes, then a determination is made in step 144 regarding the selected water level. If the selected water level is regular, then a determination is made in step 146 regarding whether a fabric load 24 is present. If that determination is no, then the control 20 opens the hot water inlet valve to admit hot water, and also dispenses an oxidizing agent in step 148. The mixture of the oxidizing agent and the hot water in the wash zone sanitizes the wash zone. The drum defining the wash zone is then spun in step 150, to assure that all portions of the machine normally having contact with the wash liquor will be subjected to the sanitizing mixture of the oxidizing agent and water. This cycle helps to prevent and remove biofilms from surfaces in the washer. This cycle works best when the water temperature is >60° C. The elevated temperature in this step, and in other steps can be achieved by admitting hot water, or by utilizing a heating element to heat the wash liquor after it is already in the wash zone, or as it is being prepared to be introduced into the wash zone, such as in a mixing chamber.

If in step 146 it is determined that a fabric load 24 is present, then the control dispenses an oxidizing agent in step 152 in an amount of 1 to 2 times the recommended amount and the fabric load is permitted to soak in the mixture of the oxidizing agent and water, in step 154, for a time period, such as up to about 80 minutes. The soaking step 154 can be carried out in a range of temperatures and is intended to be a prewash cycle, to be followed by one of the other wash cycles.

If in step 144 the selected water level is determined to be low, then in step 156 a recommended amount of oxidizing agent is added by the control 20. A determination is then made in step 158 regarding the phase that the wash liquor (here water and oxidizing agent) is to be applied to the fabric load 24. For example, the wash liquor could be applied in a foam phase, as shown in step 160, a steam phase as shown in step 162, or a concentrated wash liquor phase (low water volume) as shown in step 164. The fabric load 24 is then permitted to soak in the wash liquor, in step 166, for a time period, such as up to about 80 minutes. The soaking step 166 can be carried out in a range of temperatures and is intended to be a prewash cycle, to be followed by one of the other wash cycles. This particular soaking cycle requires less water than the previously described soaking cycle, and thus consumes less water resources.

In FIG. 4, there are illustrated several wash cycles based on low water levels. As water is added in step 140, and a determination is made in step 142 that soaking has not been selected, then a determination is made in step 170 with regard to a selected water level. If a low level has been selected, then in step 172, a determination is made regarding whether the wash liquor is to be recirculated through the fabric load 24. If recirculation is selected, then the control 20 operates the dispensing of the detergent to dispense the detergent into the wash liquor during an initial time period, ranging between 0 and 10 minutes from the start of this wash cycle, depending on the stain and soil types indicated. A prewetting with just water could be provided, prior to adding the detergent to the wash liquor, for certain types of stains. Also, a pre-wash step could be undertaken, in this cycle, and in any of the following cycles, in which no detergent is added to the wash liquor, however other additives, such as activated oxidizers, ozone, enzymes or water conditioning agents are added. The water conditioning agents can be used to remove hardness or change the pH, ORP or conductivity of the wash liquor. For other types of stains and soiling, it is more desirable to add the detergent sooner, or at the beginning of the wash cycle.

A determination is then made in step 176 regarding the method for dispensing the oxidizing agent. If a determination is made to add the oxidizing agent in bulk, then in step 178, the entirety of the charge of oxidizing agent is added during a second time period, ranging between 0 and 10 minutes from the start of this wash cycle, depending on the stain and soil types indicated. For some types of stains, it is more effective to allow the fabric load to be in contact with a detergent based wash liquor alone for a period of time before introducing an oxidizing agent. For other types of stains, it is more effective to introduce the oxidizing agent sooner, or together with the detergent. The wash liquor is then applied against the fabric load 24 via a spray or other known introduction methods including via a waterfall, through perforations in a wall of the wash zone, etc., in the recirculation mode, during step 180.

If the determination in step 176 is to meter the oxidizing agent into the wash liquor, then in step 182, the oxidizing agents are dispensed by the control 20 at a controlled rate during the second time period. For some types of stains or oxidizing agents, it is preferable to meter the oxidizing agent into the wash liquor over time, rather than dispensing it in bulk. Again, the wash liquor is then applied against the fabric load 24 by spraying in the recirculation mode, in step 180.

If the determination in step 172 was to not utilize recirculation of the wash liquor, then a determination is made in step 184 regarding the phase that the wash liquor is to be applied to the fabric load 24. For example, the wash liquor could be applied in a foam phase, as shown in step 186, a steam phase as shown in step 188, or a concentrated wash liquor phase (low water volume) as shown in step 190. A determination is then made in step 192 regarding the first additive to be dispensed into the wash liquor. If the determination is to first add detergent, then in step 194, the control 20 causes the detergent to be dispensed into the wash liquor during a first time period, ranging between 0 and 10 minutes from the start of this wash cycle, depending on the stain and soil types indicated as described above with respect to step 174. During a second time period in step 196, ranging between 0 and 20 minutes from the start of this wash cycle, the oxidizing agents are dispensed into the wash liquor. This cycle provides a low water usage wash cycle.

If in step 192 the first additive is determined to be an oxidizing agent, then in step 198, the control 20 causes the oxidizing agent to be dispensed into the wash liquor during a first time period, ranging between 0 and 10 minutes from the start of this wash cycle, depending on the stain and soil types. For some types of stains, it is more effective to first apply a wash liquor and oxidizing agent before introducing a detergent. During a second time in step 200, ranging between 0 and 20 minutes from the start of this wash cycle, the detergent is dispensed into the wash liquor. This cycle also provides a low water wash cycle which can be performed through a wide range of water temperatures.

A stain booster cycle may be provided as a generic cycle to remove all types of stains, with an emphasis on stains like background soil, blood, grass, chocolate, cooking oil, dirt, red wine, tomato, fruit juice, tea/coffee. For this cycle, the user could select either a hot wash liquor, above 60 C, a warm wash liquor of about 40 C or a cold wash liquor of less than 20 C. In this cycle, an oxidizing agent or an enzyme-containing booster would be added to the wash liquor in a high concentration level. In a first wash cycle, during a first period of time, a wash liquor without detergent, such as only water, or water with water softening conditioners, could be introduced to the substrate load, with mechanical action applied to the substrate load. After a first time period, for example 5 minutes, a detergent would be added to the wash liquor and mechanical action would continue. Alternatively, the detergent could be added immediately. After a second time period, for example, another 5 to 10 minutes, an oxidizing agent would be added to the wash liquor, with mechanical action continuing. The substrate load would remain exposed to the wash liquor, with the oxidizing agent, for a third time period to complete the washing portion of the wash cycle. The timing of the introduction and total cycle length could be dependent on temperature, stains, load size, and other wash parameters.

In another stain booster wash cycle, during a first period of time, a wash liquor without detergent, such as only water, or with activated oxidizers, ozone, enzymes or water conditioning agents could be introduced to the substrate load, with mechanical action applied to the substrate load. Water conditioning agents can be used to remove hardness, change the pH, ORP or conductivity of the wash liquor.

After a first time period, for example 5 minutes, an oxidizing agent would be added to the wash liquor and mechanical action would continue. Alternatively, the oxidizing agent could be added immediately. After a second time period, for example, another 5 minutes, an oxidizing agent would be added to the wash liquor, with mechanical action continuing. The substrate load would remain exposed to the wash liquor, with the detergent, for a third time period to complete the washing portion of the wash cycle. The timing of the introduction and total cycle length could be dependent on temperature, stains, load size, and other wash parameters.

Another slightly different stain booster cycle may be provided for bleach sensitive stains, such as chocolate, red wine, fruit juices, tea/coffee, ring around the collar. This cycle would be similar to the generic stain booster cycles described above, however the addition of the second chemistry, the oxidizing agent in the first cycle, or the detergent in the second described cycle, would occur sooner, that is, less than 5 minutes after the introduction of the first chemistry, to allow the oxidizing agent to have more time to act on the stain. The total cycle time could be extended longer as well.

Figures 4, 4A, 4B, 5, 6:
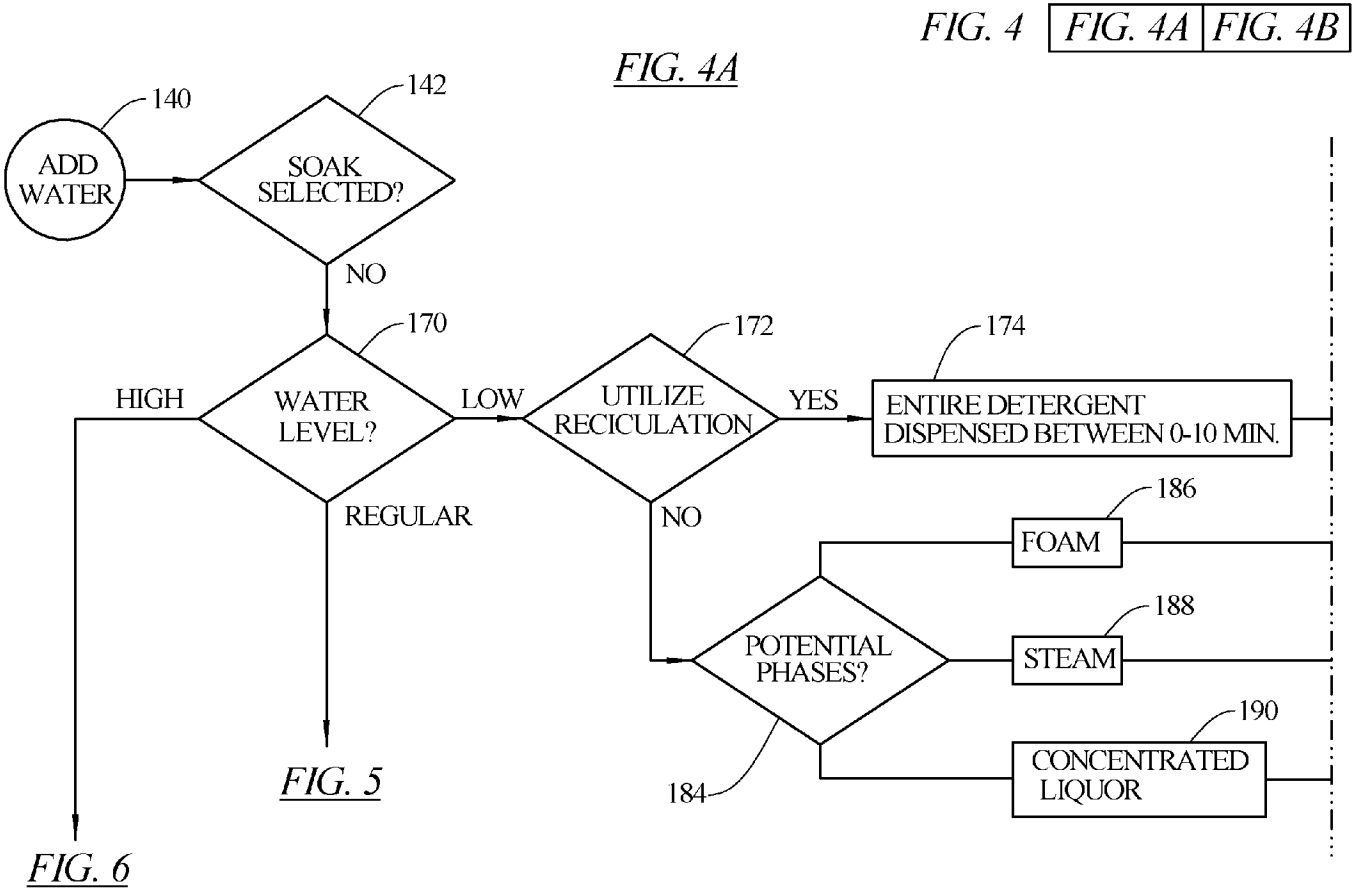
FIG. 5 is a flow chart diagram of a wash cycle embodying the principles of the present invention.
FIG. 6 is a flow chart diagram of a wash cycle embodying the principles of the present invention.
Figure 4B:
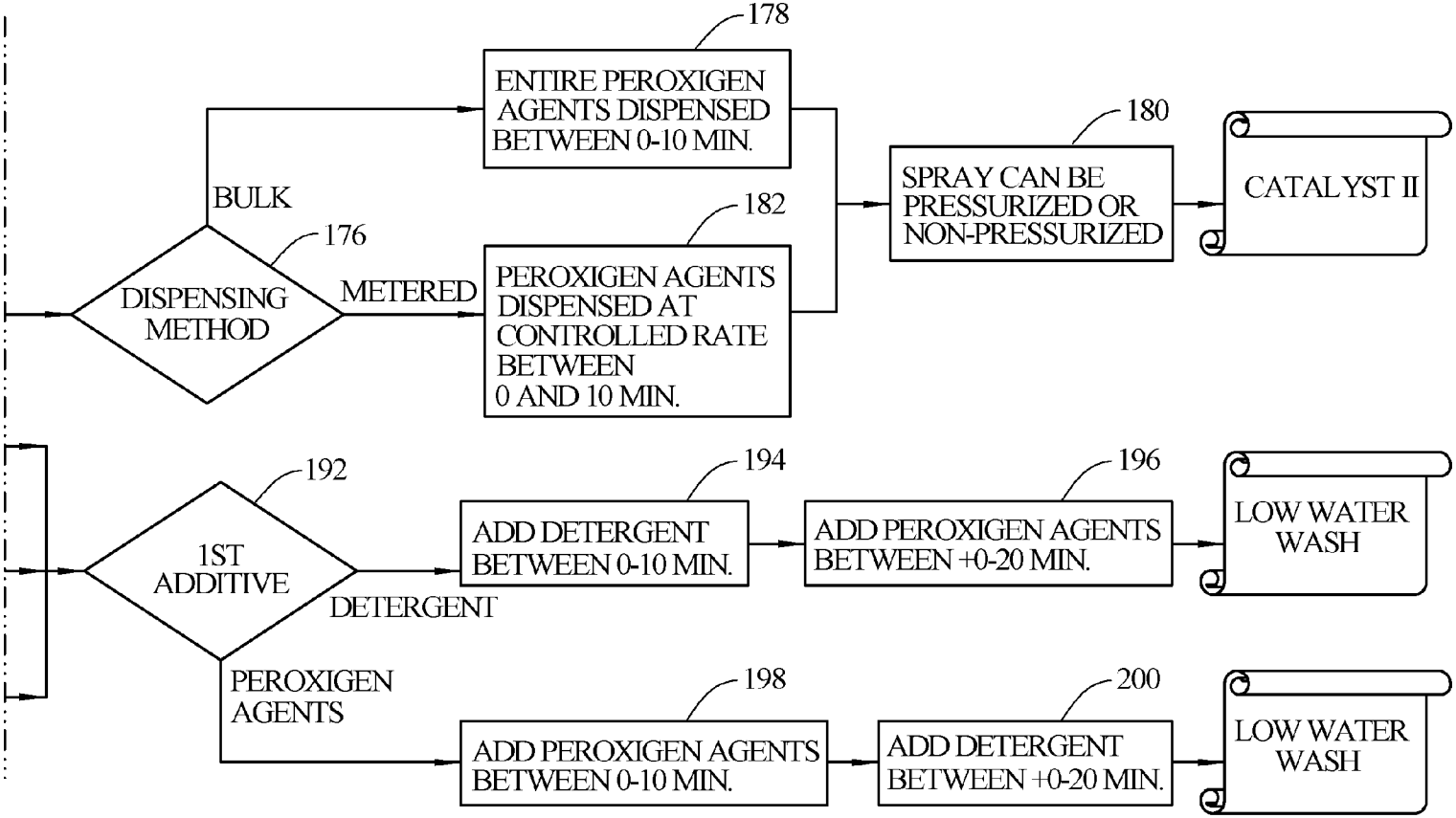
Figures 5, 5A, 5B, 5C, 6:
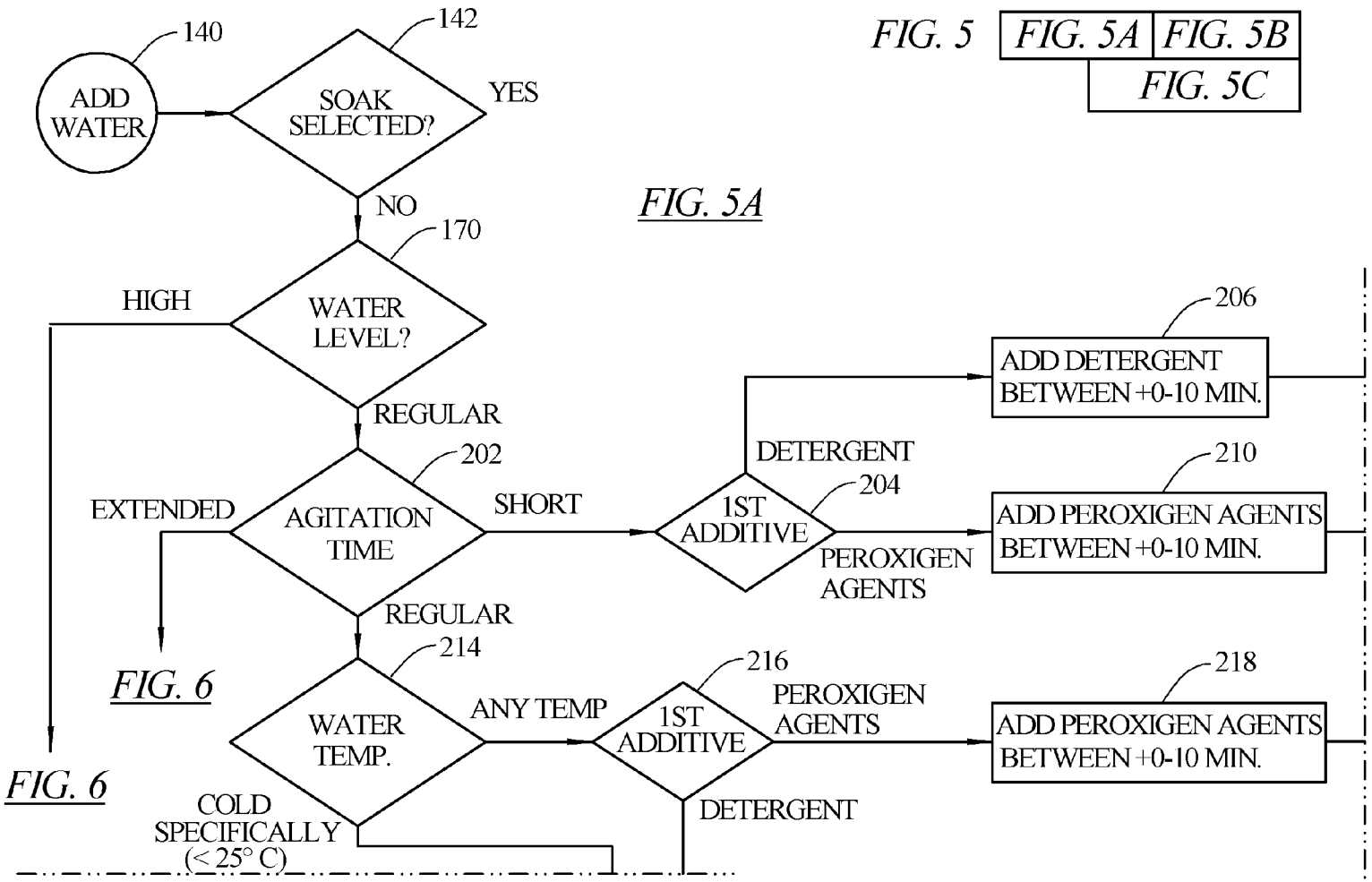
Figure 5B:
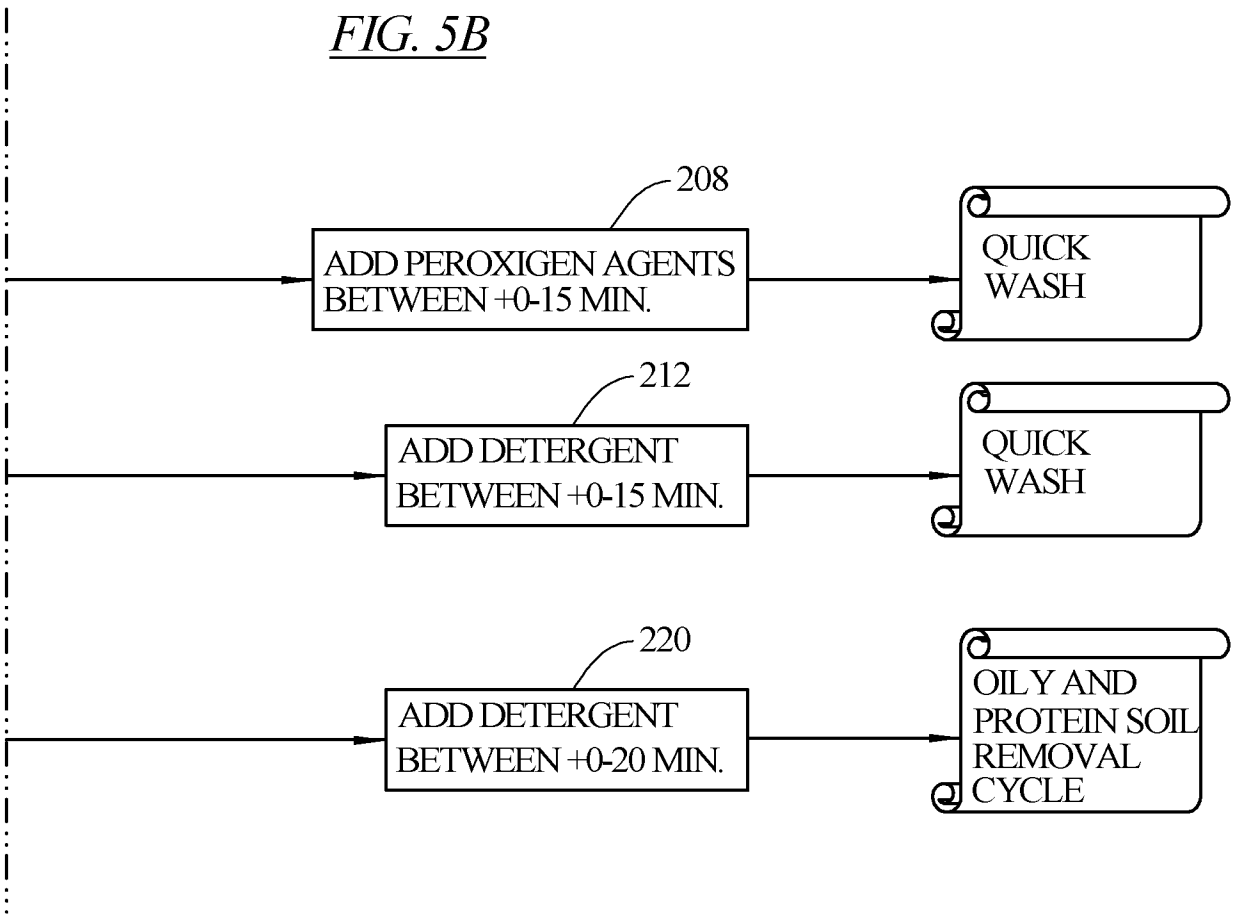
Figure 5C:
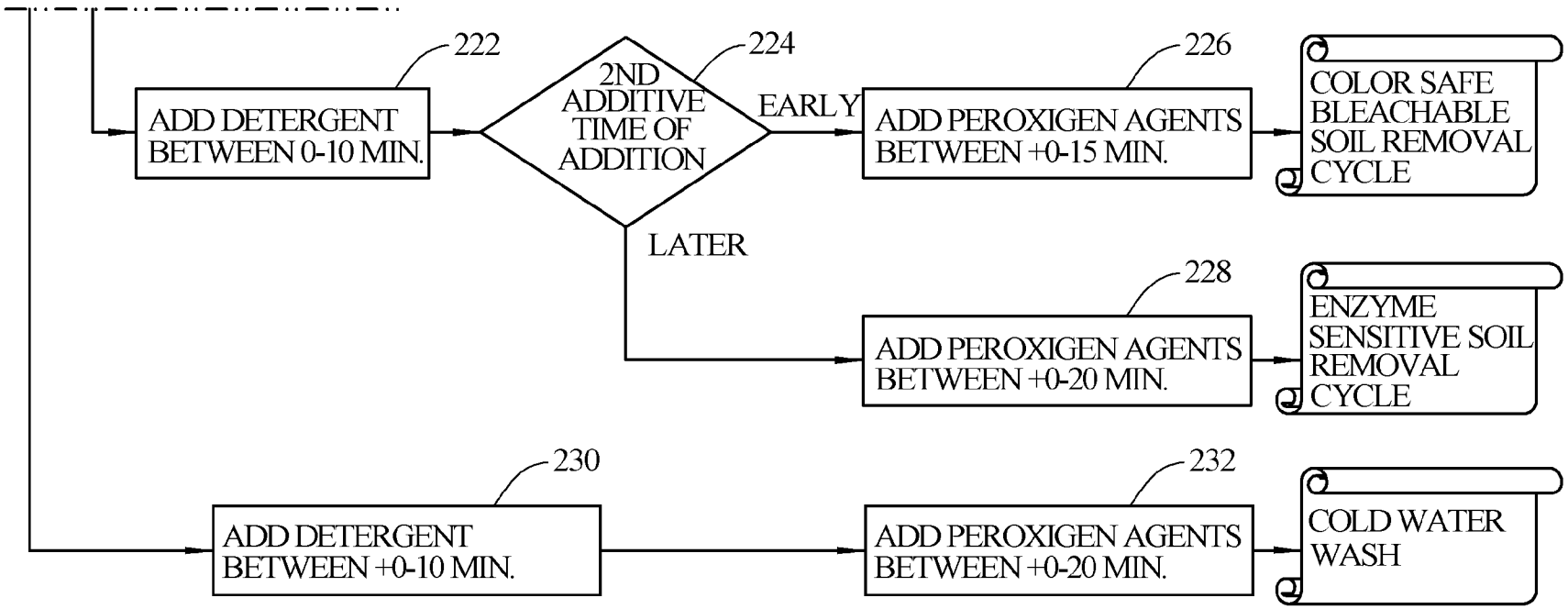
Figures 6, 6A:
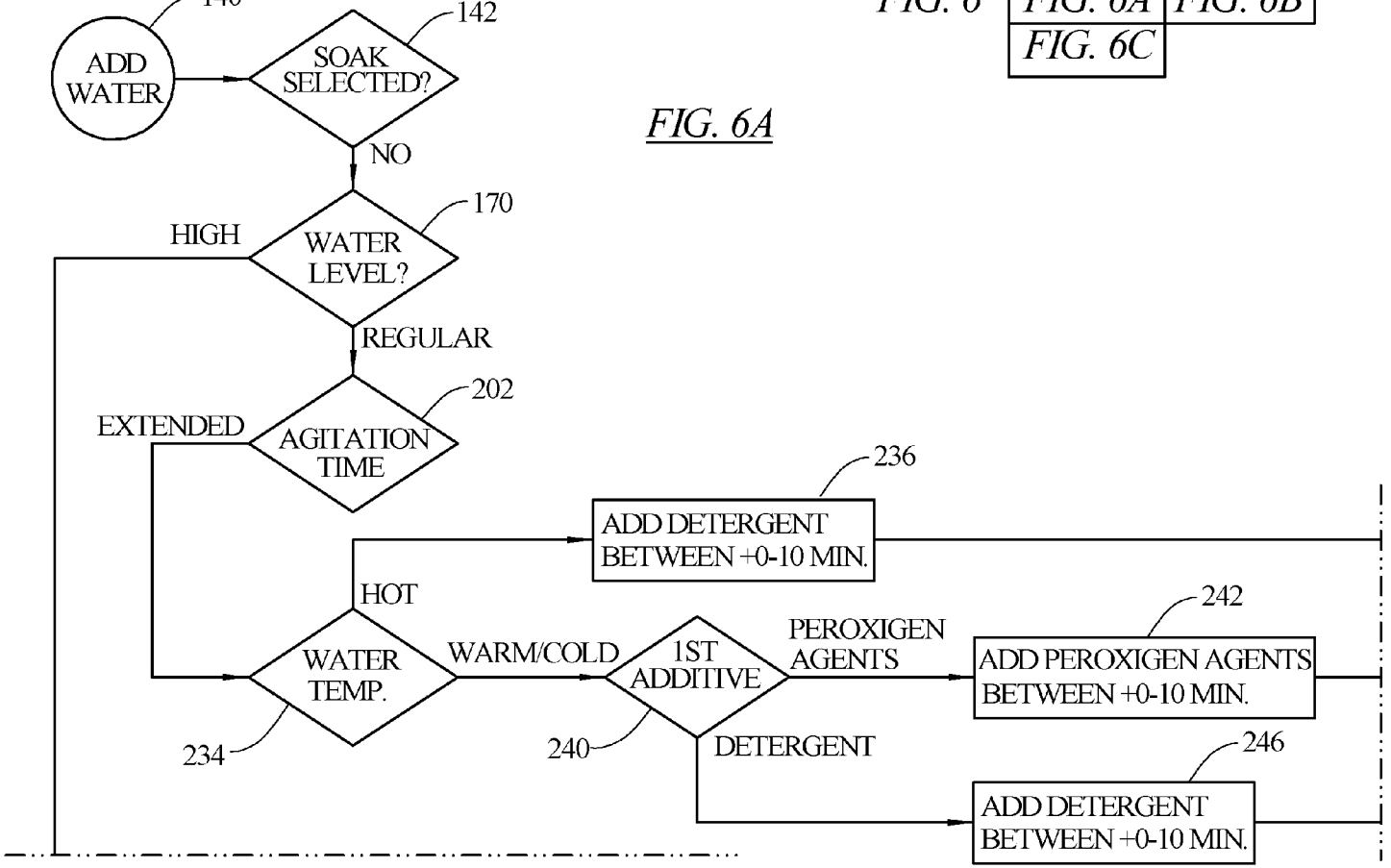
Figure 6B:
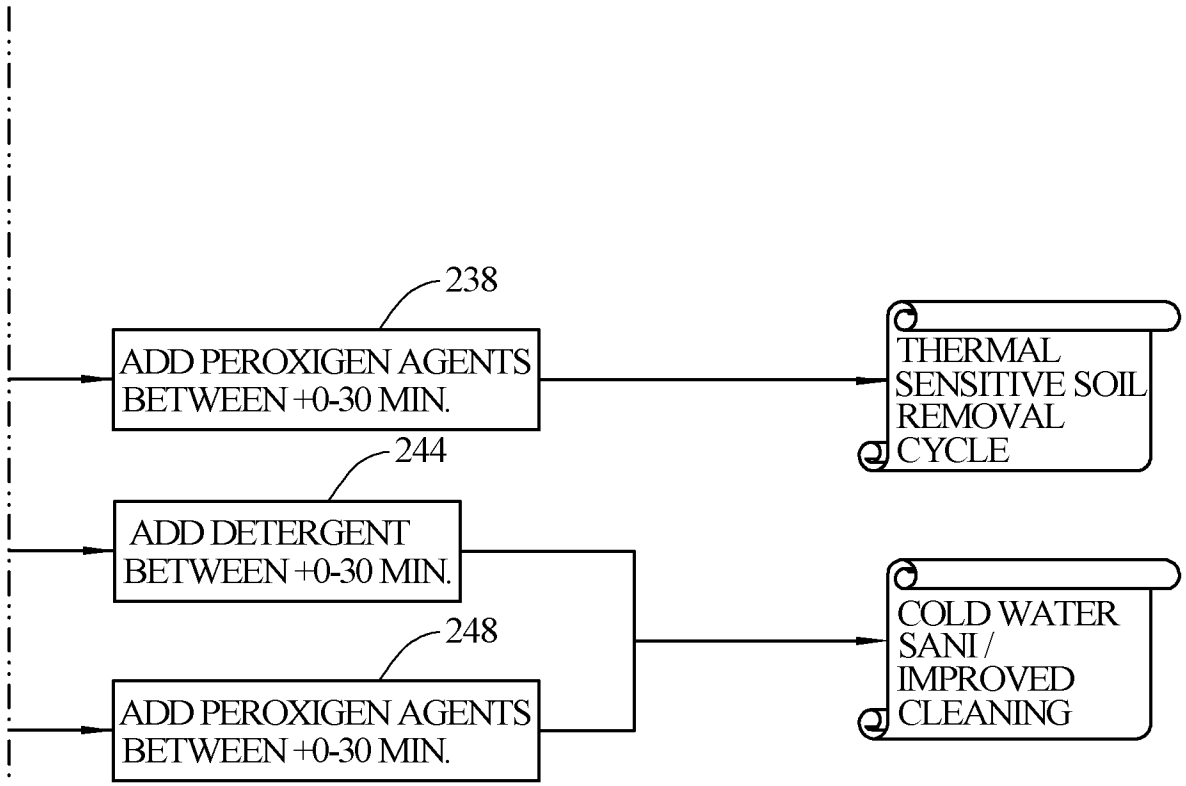
Figure 6C:
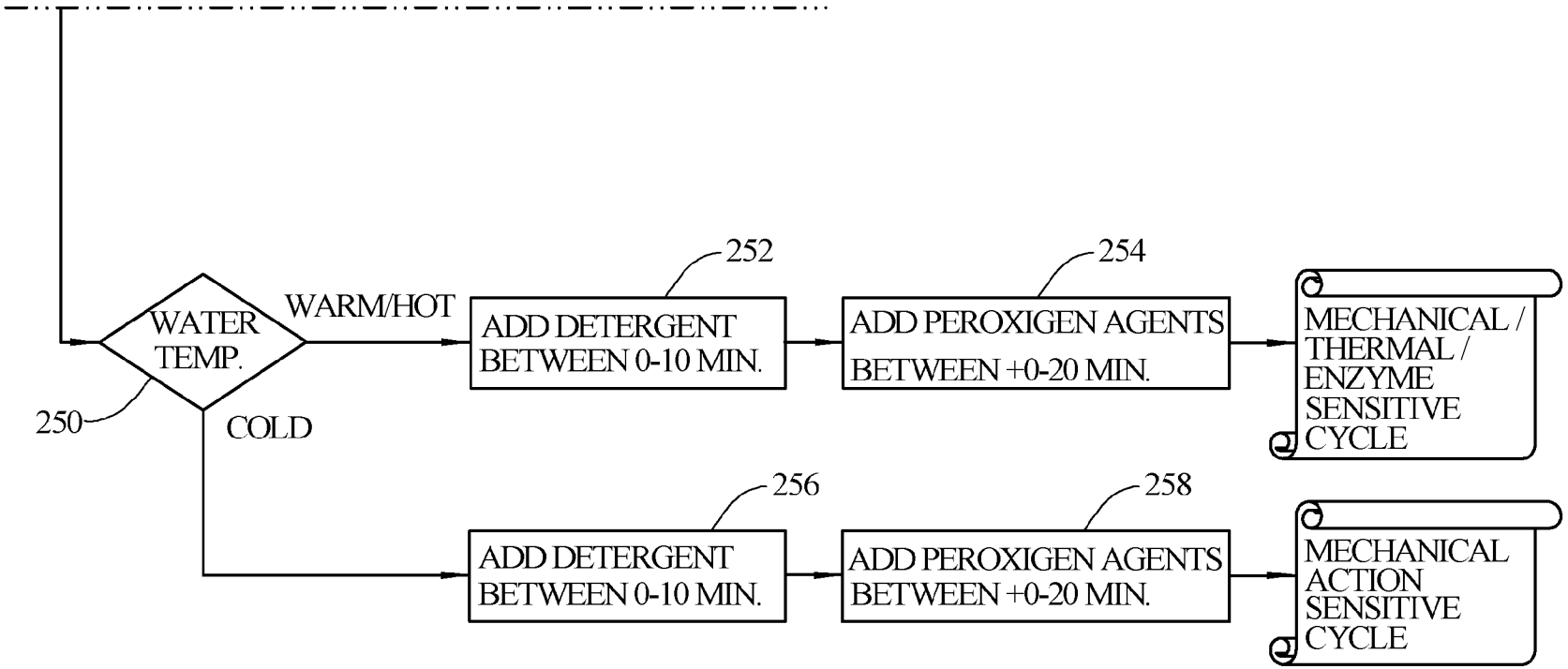

In FIG. 5, there are illustrated several wash cycles based on regular water levels and short or regular agitation times. As water is added in step 140, and a determination is made in step 142 that soaking has not been selected, then a determination is made in step 170 with regard to a selected water level. If a regular level has been selected, then in step 202, a determination is made regarding the length of the agitation time. If a short agitation time is selected, a determination is then made in step 204 regarding the first additive to be dispensed into the wash liquor. If the determination is to first add detergent, then in step 206, the control 20 causes the detergent to be dispensed into the wash liquor during a first time period, ranging between 0 and 10 minutes from the start of this wash cycle, depending on the stain and soil types indicated as described above with respect to step 174. During a second time period in step 208, ranging between 0 and 15 minutes from the start of this wash cycle, the oxidizing agents are dispensed into the wash liquor. This cycle provides a quick wash cycle.

If in step 204 the first additive is determined to be an oxidizing agent, then in step 210, the control 20 causes the oxidizing agent to be dispensed into the wash liquor during a first time period, ranging between 0 and 10 minutes from the start of this wash cycle, depending on the stain and soil types. During a second time in step 212, ranging between 0 and 15 minutes from the start of this wash cycle, the detergent is dispensed into the wash liquor. This cycle also provides a quick wash cycle.

If a regular agitation time is selected in step 202, a determination is then made in step 214 regarding a temperature for the wash liquor. If any temperature other than specifically cold is selected, then in step 216 is made regarding the first additive to be dispensed into the wash liquor. If the determination is to first add the oxidizing agent, then in step 218, the control 20 causes the oxidizing agent to be dispensed into the wash liquor during a first time period, ranging between 0 and 10 minutes from the start of this wash cycle, depending on the stain and soil types. During a second time period in step 220, ranging between 0 and 20 minutes from the start of this wash cycle, the detergent is dispensed into the wash liquor. This cycle provides a wash cycle particularly suited to remove oily soils and protein stains, such as blood or grass stains.

If in step 216 the first additive is determined to be a detergent, then in step 222, the control 20 causes the detergent to be dispensed into the wash liquor during a first time period, ranging between 0 and 10 minutes from the start of this wash cycle, depending on the stain and soil types. A determination is then made in step 224 whether the oxidizing agent is to be dispensed early or later. If the determination is early, then during a second time period in step 226, ranging between 0 and 15 minutes from the start of this wash cycle, the oxidizing agent is dispensed into the wash liquor. This cycle is suited for color safe bleachable soil removal.

A slightly different stain booster cycle may be provided for enzyme sensitive stains, such as blood, grass, chocolate and cooking oil. This cycle would be similar to the generic stain booster cycles described above, however the addition of the second chemistry, the oxidizing agent in the first cycle, or the detergent in the second described cycle, would be delayed to occur between 10 and 20 minutes after the introduction of the first chemistry, to allow the first chemistry sufficient time to act on the stain. The total cycle time could be extended longer as well. With cold wash liquor washes, the time could also be determined by the detergent that is used, such that the delayed time of introduction of the oxidizing agent, following the introduction of the detergent, could be 10 minutes if the detergent is a cold water formulated detergent and 20 minutes if the detergent has standard enzymes.

For this cycle, a determination is made in step 224 to add the oxidizing agent later, then during a second time period in step 228, ranging between 0 and 20 minutes from the start of this wash cycle, the oxidizing agent is dispensed into the wash liquor. This cycle is suited for removing enzyme sensitive soils, which is why the oxidizing agent is dispensed into the wash liquor later, to allow the enzyme based detergent a longer contact time with the fabric load 24.

A low resource cycle could be provided in which the wash liquor temperature would be cold, that is, below 20 C. In this cycle, the length of time that each chemistry is exposed to the substrate load would be increased due to the reduced temperature. The entire cycle time would therefore be lengthened. This cycle provides a lower energy usage cycle.

For this cycle, a determination is made in step 214 specifically for a cold wash temperature. Then in step 216, the control 20 causes the detergent to be dispensed into the wash liquor during a first time period, ranging between 0 and 10 minutes from the start of this wash cycle, depending on the stain and soil types indicated as described above with respect to step 174. During a second time period in step 232, ranging between 0 and 20 minutes from the start of this wash cycle, the oxidizing agents are dispensed into the wash liquor. This cycle provides a cold water wash cycle (reduced energy usage). It has been determined, using cleaning scores, that a wash cycle using detergent and an oxidizing agent, at temperatures between 15 and 25 C provides results as good as or better than a wash cycle using only a detergent at 40 C.

An extra low resource cycle could be provided in which the wash liquor temperature would be cold, that is, below 20 C, the length of the cycle in greatly increased, to about 4 to 7 hours, with the intent that this cycle be performed overnight, taking advantage of lower nighttime electricity rates. The addition of the second chemistry would occur substantially later, such as 30 minutes to an hour or more after the addition of the first chemistry. In this cycle, the length of time that each chemistry is exposed to the substrate load would be increased due to the reduced temperature and the cycle would include long periods of soaking the substrate load in the wash liquor with intermittent periods of mechanical action against the substrate load, such as spraying, tumbling or agitating. This cycle cold provide significant energy cost savings.

In FIG. 6, there are illustrated several wash cycles based on a regular water level and an extended agitation time or a high water level. As water is added in step 140, and a determination is made in step 142 that soaking has not been selected, a determination is made in step 170 for a regular water level and in step 202 a determination is made for an extended agitation time, a determination is made in step 234 regarding a wash temperature. If hot temperatures have been selected, then in step 236, the control 20 causes the detergent to be dispensed into the wash liquor during a first time period, ranging between 0 and 10 minutes from the start of this wash cycle, depending on the stain and soil types indicated as described above with respect to step 174. During a second time period in step 238, ranging between 0 and 30 minutes from the start of this wash cycle, the oxidizing agents are dispensed into the wash liquor. This cycle provides a wash cycle for removing thermally sensitive soils, such as oily soils.

A cold sanitization cycle could be provided to kill bacterial on all types of substrates without damage to the substrate that might otherwise occur at an elevated temperature. For this cycle, the wash liquor is generally maintained below 60 C, and could be around 40 C for a warm cycle, or around 20 C for a cold cycle. In this cycle, an oxidizing agent and a detergent would be added to the wash liquor, relatively simultaneously, and in a concentration amount greater than normal. Typically, the lower the temperature, the greater the concentration level should be for the additives. The substrate is to remain exposed to the additives for a time period that is longer than typically required for a high temperature sanitization cycle. Usually such a cycle, with a wash liquor temperature of 70 C requires a 10 minute exposure period. In this cycle, with the temperature being below 60 C and down to 20 C, the time period should be in the range of 20 to 120 minutes. Such a cycle requires less energy usage due to the lower temperatures.

The cold sanitization cycle begins if the temperature selected in step 234 is warm or cold. Then in step 240 a determination is made regarding the first additive to be dispensed into the wash liquor. If the determination is to first add the oxidizing agent, then in step 242, the control 20 causes the oxidizing agent to be dispensed into the wash liquor during a first time period, ranging between 0 and 10 minutes from the start of this wash cycle, depending on the stain and soil types. During a second time period in step 244, ranging between 0 and 30 minutes from the start of this wash cycle, the detergent is dispensed into the wash liquor. This cycle provides a wash cycle that sanitizes and provides improved cleaning due to the extended period of time the fabric load is exposed to oxidizing agents.

If in step 240 the first additive is determined to be a detergent, then in step 248, the control 20 causes the detergent to be dispensed into the wash liquor during a first time period, ranging between 0 and 10 minutes from the start of this wash cycle, depending on the stain and soil types. During a second time period in step 248, ranging between 0 and 30 minutes from the start of this wash cycle, the oxidizing agent is dispensed into the wash liquor. This cycle also provides a wash cycle that sanitizes and provides improved cleaning due to the extended period of time the fabric load is exposed to oxidizing agents.

If a determination is made in step 170 for a high water level, a determination is made in step 250 regarding a wash temperature. If warm or hot temperatures have been selected, then in step 252, the control 20 causes the detergent to be dispensed into the wash liquor during a first time period, ranging between 0 and 10 minutes from the start of this wash cycle, depending on the stain and soil types indicated as described above with respect to step 174. During a second time period in step 254, ranging between 0 and 20 minutes from the start of this wash cycle, the oxidizing agents are dispensed into the wash liquor. This cycle provides a mechanical/thermal/enzyme sensitive wash cycle which is particularly suited for removing carbon and cocoa based soils and stains.

If the temperature selected in step 250 is cold, then in step 256, the control 20 causes the detergent to be dispensed into the wash liquor during a first time period, ranging between 0 and 10 minutes from the start of this wash cycle, depending on the stain and soil types. During a second time period in step 258, ranging between 0 and 20 minutes from the start of this wash cycle, the oxidizing agent is dispensed into the wash liquor. This cycle provides a mechanical action sensitive cycle (high water volume) with a lower energy usage (due to the cold water selection) than the previous wash cycle.

A whitening cycle could be provided in which the overall whitening of the substrate is improved through removal of background soil and bleaching. The user could select any temperature for this wash cycle. A normal concentration of detergent would be used, but a higher concentration of an oxidizing agent or and enzyme-containing booster would be added.

The various times listed for each of the steps are merely illustrative, and can be lengthened or shortened as desired to improve performance or other characteristics of the wash cycle.

Various features of the control 20 and washer 22 have been described which may be incorporated singly or in various combinations into a desired system, even though only certain combinations are described herein. The described combinations should not be viewed in a limiting way, but only as illustrative examples of particular possible combinations of features. As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A control for an automatic washer having a wash zone for receiving a substrate load to be washed through contact with a wash liquor, a dispenser arranged to receive chemistries to be added to the wash zone, a container in communication with the dispenser to receive the chemistries or precursors for the chemistries to be added to the wash zone, the control arranged to operate the washer through a wash cycle determined based upon various soils and stains in the substrate load to be washed with the wash liquor in the wash zone of the washer, the control comprising:

a user interface with user operable mechanisms to permit a user to customize the operation of the control, a plurality of stain/soil type entrées displayed at the user interface, the user operable mechanisms being arranged to permit the user to select a stain/soil type, a stain component sensor located in the wash zone to detect a particular type of stain on the substrate load to be cleaned, the control having dispensing control arranged to operate the dispenser to introduce at least one wash liquor additive into the wash liquor selected based upon the selections made by the user via the user interface from the group consisting of detergents, chlorine bleaches, color safe bleaches, cleaning boosters, oxidizing agents, pre-wash stain removers, pre-wash chemistries, switchable or tunable surfactants, wrinkle guard, color finishes, water repellency, stain guard, functional finishes, fabric softeners, water softeners, fragrances, anti-static agents, drying aids, de-wrinkling chemistries, deodorizers, surfactants, emulsifiers, enzyme activated stain removers, sudsing agents, builders, anti-redeposition polymers, in-wash stain removers, perfumes, and activators and deactivators for other members of the group of additives, a timing mechanism, and the control having operational control over the particular wash cycles using the dispensing control to dispense additives to the wash liquor at times determined by the timing mechanism during the wash cycle.

2. The control according to claim 1, further including a plurality of predetermined wash cycles stored in a memory of the control, for use in operating the washer based upon a user selected stain.

3. The control according to claim 1, wherein the timing mechanism comprises a timer used to dispense particular wash liquor additives at specific times during a particular wash cycle.

4. The control according to claim 1, wherein the user interface permits the user to elect whether to or not to dispense a particular type of wash liquor additive for a particular wash cycle.

5. The control according to claim 1, wherein the user interface permits the user to determine a time for releasing a particular wash liquor additive during a particular wash cycle.

6. The control according to claim 1, wherein the user interface comprises an electromechanical dial with multiple user selectable positions.

7. The control according to claim 1, wherein the stains to be cleaned are identified by the user interface as one of proteins, fats, semisolids, complex, particular, soil, enzyme sensitive, pH sensitive and surfactant sensitive.

8. The control according to claim 1, wherein the stain/soil type entrées are selected from the group consisting of grass, blood, coffee, tea, red wine, tomato-based, fruit juices, cocoa, carbon, perspiration, dirt, pigments, colors, foods, mud and oily stains and soils.

9. A substrate treating appliance utilizing a plurality of different chemistries for different cycles or different wash loads, comprising:

a wash zone for receiving a substrate load to be washed through contact with a wash liquor, a dispenser arranged to receive chemistries to be added to the wash zone, a container in communication with the dispenser to receive the chemistries or precursors for the chemistries to be added to the wash zone;

a control for operating the appliance comprising:

a user interface with user operable mechanisms to permit a user to customize the operation of the control, a plurality of stain/soil type entrées displayed at the user interface, the user operable mechanisms being arranged to permit the user to select a stain/soil type, a stain component sensor located in the wash zone to detect a particular type of stain on the substrate load to be cleaned, the control having dispensing control arranged to operate the dispenser to introduce at least one wash liquor additive into the wash liquor selected based upon the selections made by the user via the user interface from the group consisting of detergents, chlorine bleaches, color safe bleaches, cleaning boosters, oxidizing agents, pre-wash stain removers, pre-wash chemistries, switchable or tunable surfactants, wrinkle guard, color finishes, water repellency, stain guard, functional finishes, fabric softeners, water softeners, fragrances, anti-static agents, drying aids, de-wrinkling chemistries, deodorizers, surfactants, emulsifiers, enzyme activated stain removers, sudsing agents, builders, anti-redeposition polymers, in-wash stain removers, perfumes activators and deactivators for other members of the group of additives, a timing mechanism, and the control having operational control over the particular wash cycles using the dispensing control to dispense additives to the wash liquor at times determined by the timing mechanism based on the selected or detected stain or soil during the wash cycle.

10. The substrate treating appliance according to claim 9, wherein the user interface permits selection by the user of a wash liquor temperature.

11. The substrate treating appliance according to claim 9, wherein the user interface permits selection by the user of a delay period for dispensing the first wash liquor additive.

12. The substrate treating appliance according to claim 9, wherein the user interface permits selection by the user of a particular additive to be added or not added to the wash liquor.

* * * * *